US006027415A

United States Patent [19]

Takeda

[11] Patent Number: 6,027,415

[45] Date of Patent: Feb. 22, 2000

[54] SET OF IRON GOLF CLUBS

[75] Inventor: Hitoshi Takeda, Tsubame, Japan

[73] Assignee: Kabushiki Kaisha Endo Seisakusho, Niigata, Japan

[21] Appl. No.: 09/119,816

[22] Filed: Jul. 21, 1998

[30] Foreign Application Priority Data

Nov. 26, 1997 [JP] Japan ..... 9-324740

[51] Int. Cl.[7] ..... A63B 53/04

[52] U.S. Cl. ..... 473/291; 473/350

[58] Field of Search ..... 473/350, 349, 473/324, 291, 290

[56] References Cited

U.S. PATENT DOCUMENTS

| | | | |
|---|---|---|---|
| 4,555,112 | 11/1985 | Masghati | 473/289 |
| 4,869,507 | 9/1989 | Sahm | 473/337 |
| 5,062,638 | 11/1991 | Shira | 473/350 |
| 5,423,535 | 6/1995 | Shaw | 473/291 |
| 5,549,297 | 8/1996 | Mahaffey | 473/290 |
| 5,879,243 | 3/1999 | Hackman | 473/342 |

FOREIGN PATENT DOCUMENTS

| | | |
|---|---|---|
| 58-86157 | 11/1958 | Japan . |
| 9-285576 | 11/1997 | Japan . |

*Primary Examiner*—Jeanette Chapman
*Assistant Examiner*—Stephen L. Blau
*Attorney, Agent, or Firm*—Quarles & Brady LLP

[57] ABSTRACT

A set of iron golf clubs whose balance weights are able to be easily manufactured, with a well-harmonized design as a set of golf clubs. The specific gravity of the materials of balance weights 17 are changed per each club number. Thus, the weight of the respective balance weights 17 can be changed per each club number, without changing the shape and size thereof. For example, the specific gravity of the materials of the balance weights 17 may be made larger as the club number increases, thus enabling the setting of the weight of the respective heads 1 for each club number, with the weight of the respective head body 17 being kept substantially constant.

6 Claims, 6 Drawing Sheets

SET OF IRON GOLF CLUBS

BACKGROUND OF INVENTION

1. Filed of the Invention

The present invention relates to a set of iron golf clubs.

2. Prior Art

A set of iron golf clubs is, for example, a set of a plurality of golf clubs, from a long iron or the 1st iron through a short iron or the 9th iron, a pitching wedge or sandwedge. The respective dimensional elements of these clubs are different, depending on their predetermined settings. First, a shaft gets shorter as its club number increases, accompanied by the weight of a club head getting heavier. Further, a loft angle, i.e., an angle of a vertical plane to a face of a club head increases as the club number gets larger. Further, the larger the club number is, the greater a lie angle, i.e., an angle of a horizontal plane to a shaft, becomes.

Conventionally, to aim at adjusting the weight distribution of a club head, it has been proposed, for example in Japanese Utility Model Application Unexamined Publication No.58-86157, to provide a balance weight at the rear side of a head body, said balance weight being made of a material denser than that of a head body. Further, to obtain a characteristic suitable for each club number, the weight and mounting position of a balance weight have been changed in the past, corresponding to each club number. According to such conventional art, when changing the weight of a balance weight for each club number, the size of the balance weight has been changed, without changing the material thereof. In other words, a specific balance weight exclusively used for a particular club number of a golf club, such as for use with the 3rd iron, the 4th iron and etc., has been manufactured.

However, if the size of a balance weight must be changed per each club number, then eleven kinds of balance weights in total are necessary, from the 1st iron through a sandwedge, which in turn means that eleven kinds of dies or molds for forging or casting also are necessary to manufacture the respective balance weights by forging or casting, so that it results in a higher cost and a more space needed for installing a manufacturing system. Moreover, if the size and shape of a balance weight vary from one club number to another, the design harmony as a set of iron golf clubs will be impaired.

SUMMARY OF THE INVENTION

It is, therefore, an object of the present invention to provide a set of iron golf clubs whose balance weight is easy to manufacture.

It is another object of the invention to provide a set of iron golf clubs whose design is well harmonized as a set of iron golf clubs.

To attain the above objects, there is provided a set of iron golf clubs each of which comprising: a head, having a head body formed on its front face with a face and a balance weight provided in the head body; and a shaft connected to a heel side of said head, said shaft having varying length depending on the club number thereof, wherein the specific gravity of a material of the balance weight varies depending on the club number.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE INVENTION

Figure 1:
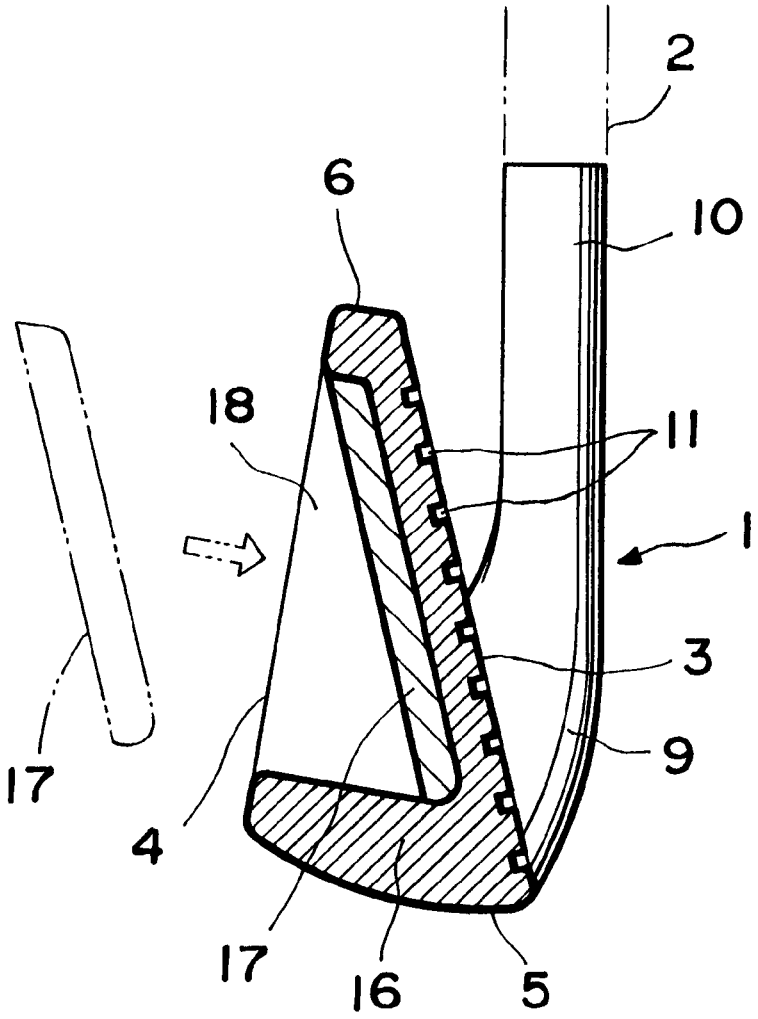
FIG. 1 is a section showing a head of a long iron of a set of iron golf clubs of a first embodiment of the invention.
Figure 2:
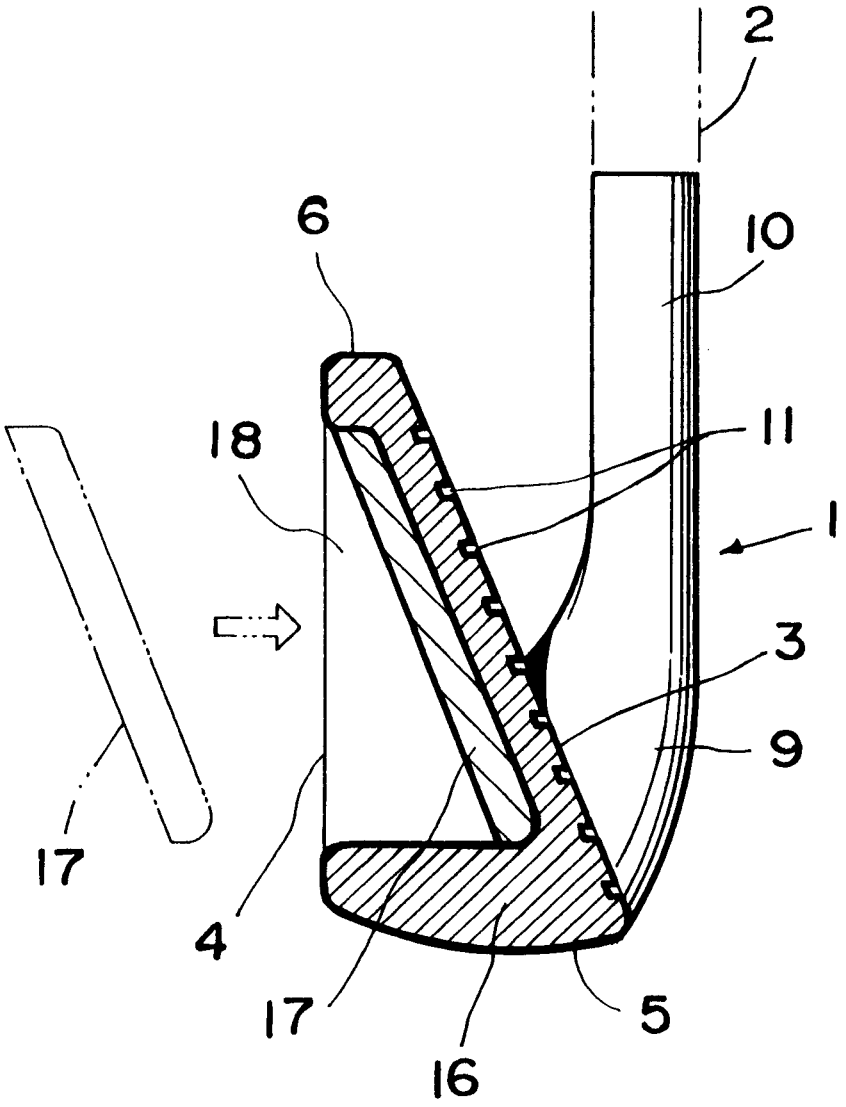
FIG. 2 is a section showing a head of a short iron of a first embodiment of the invention.
Figure 3:
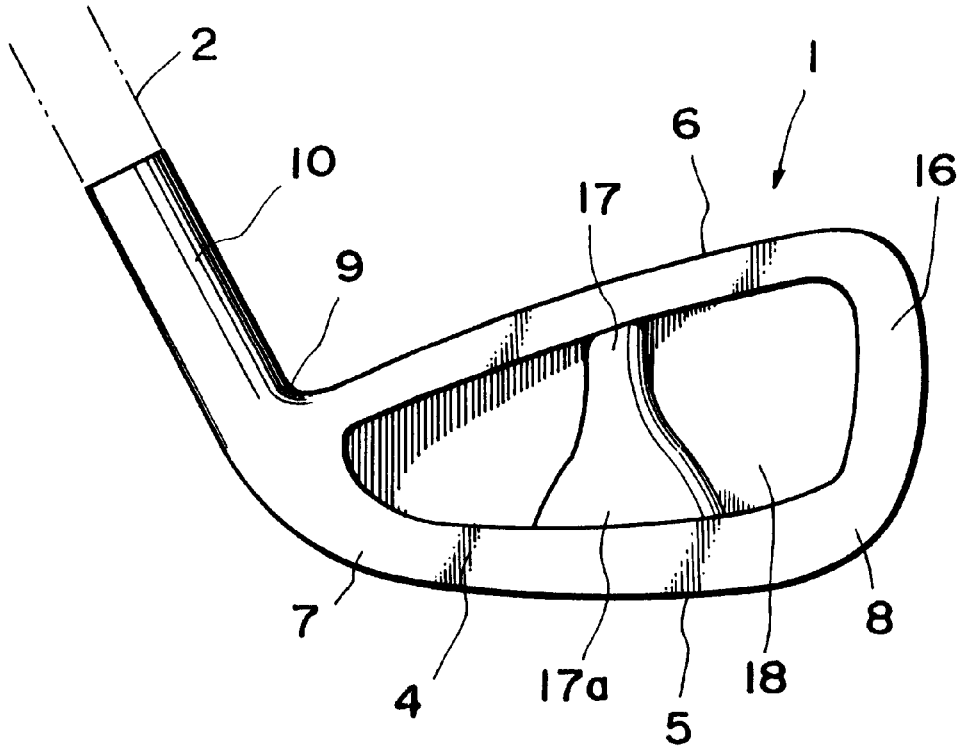
FIG. 3 is a rear view showing a head of a first embodiment of the invention.

Hereinafter is explained a first embodiment of a set of iron golf clubs of the invention with reference to FIG. 1 through FIG. 3, An iron club, as illustrated, consists of a head 1 and a shaft 2 fixed to the head 1. The head 1 has a face 3 at its front face, a back 4 at its rear side, a sole 5 at its lower side, a top 6 at its upper side, a heel 7 at its proximal side and a toe 8 at its distal side, respectively. The heel 7 is formed with a neck 9, from which extends upwardly a hosel 10. The hosel 10 serves as a shaft connector for connecting the shaft 2 thereto. Reference numeral 11 designates a plurality of substantially horizontal concave grooves called score lines.

A set of iron golf clubs of the invention is either a set of eleven iron clubs including the 1st to 9th irons, a pitching wedge and a sandwedge, or a set of plural iron clubs excluding some therefrom. Although all of these golf clubs are not shown in drawings, dimensional elements of each golf club of a golf club set vary depending on the respective settings. First, as a club number grows, the shaft 2 becomes shorter, accompanied by an increasing weight of the head 1. Further, the larger a club number becomes, the larger a loft angle or an angle of the face 3 to a vertical plane becomes. Furthermore, the larger a club number becomes, the larger a lie angle or an angle of the shaft 2 to a horizontal plane becomes as well. To take examples, a section of the head 1 of a long iron is shown in FIG. 2, while that of a short iron in FIG. 3.

Said head 1 consists of a head body 16 making up the majority portion thereof, including the face 3, and a balance weight 17 which is block-shaped and fixed to the back 4 side of the head body 16. The back 4 side of the head body 16 is formed with a cavity 18 which is formed by recessing the back 4 except its periphery. As widely recognized, the cavity 18 serves to enlarge the area of the face 3 and a sweet area. What is called a sweet area is an area on the face 3 where balls travel comparatively straight and well when struck thereon.

Said balance weight 17 is joined into the cavity 18 of the head body 16 by suitable means, such as mechanical fixing with welding or screws, or press-fitting with a press device. The balance weight 17 is located in the center of the inside of the cavity 18 relative to its heel to toe direction, which is formed narrow as it extends from the lower face of the cavity 18 to the upper face thereof. Further, the lower portion of the balance weight 17 is formed with a widened portion 17*a* which is wider than the upper portion thereof.

Although the shape of the head body 16 differs per each club number, the weight thereof is substantially the same, regardless of the club number. For the material of the head body 16 can be used a suitable one, which is desirably light and stiff one such as titanium or titanium alloy. With such a light material, the head body 16 can be enlarged, and the face 3 for striking balls can also be enlarged. With the enlarged face 3, then it becomes easy to see due to its wide area, when setting up the head 1 to strike a ball. At the same time, it is made possible to diminish the loft angles when setting each dimensional element of golf clubs.

Although the shape and size of each of said balance weights 17 do not depend on its club number, yet the specific gravity of the material thereof varies from one club number to another. The specific gravity of the material of each of the balance weights 17 increases as the club number increases. As a result, the weight of the respective balance weights 17 becomes heavier as the club number grows. It should be noted that since the weight of the respective head bodies 16 does not depend on the club number and is nearly constant, the weight of the respective heads 1 becomes heavier as the club number grows. Incidentally, the specific gravity of the material of the respective balance weights 17 is larger than that of the material of the respective head bodies 16 corresponding thereto.

To systematically vary the specific gravity of the material of the respective balance weights 17 per each club number, certain alloy with different compositional ratios may be used, for example. Table 1 shows an example in which copper tungsten alloy is used.

TABLE 1

| | Compositional Ratio | Specific Gravity |
|---|---|---|
| 1) | 10Cu-90W | 17.2 |
| 2) | 20Cu-80W | 15.5 |
| 3) | 30Cu-70W | 14.3 |
| 4) | 40Cu-60W | 13.2 |
| 5) | 50Cu-50W | 12.1 |

For example, the alloy of the above 5) may be used for the 1st and 2nd irons, the alloy of the above 4) for the 3rd and 4th irons, the alloy of the above 3) for the 5th and 6th irons, the alloy of the above 2) for the 7th and 8th irons, and the alloy of the above 1) for the 9th, pitching wedge and sandwedge, respectively.

As mentioned above, a set of iron golf clubs generally has the respective shafts 2 getting shorter as the club number increases and thus the weight of the respective heads 1 become heavier. According to the invention, with the material of the respective balance weights 17 becoming heavier as the club number increases, the differences in weight among the respective heads 1 can be set, using the balance weights 17, with the shape and size of the respective balance weights 17 being the same irrespective of the club number.

Figure 4:
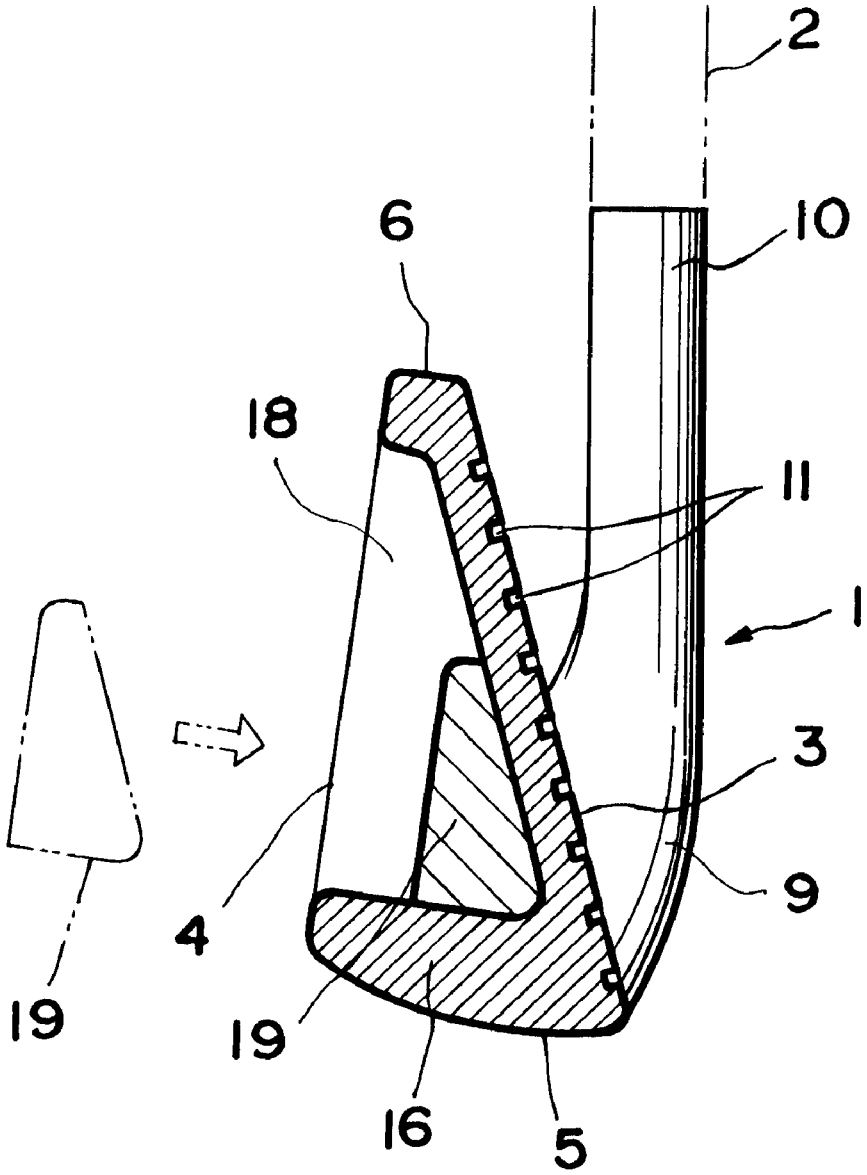
FIG. 4 is a section showing a head of a long iron of a set of iron golf clubs of a second embodiment of the invention.
Figure 5:
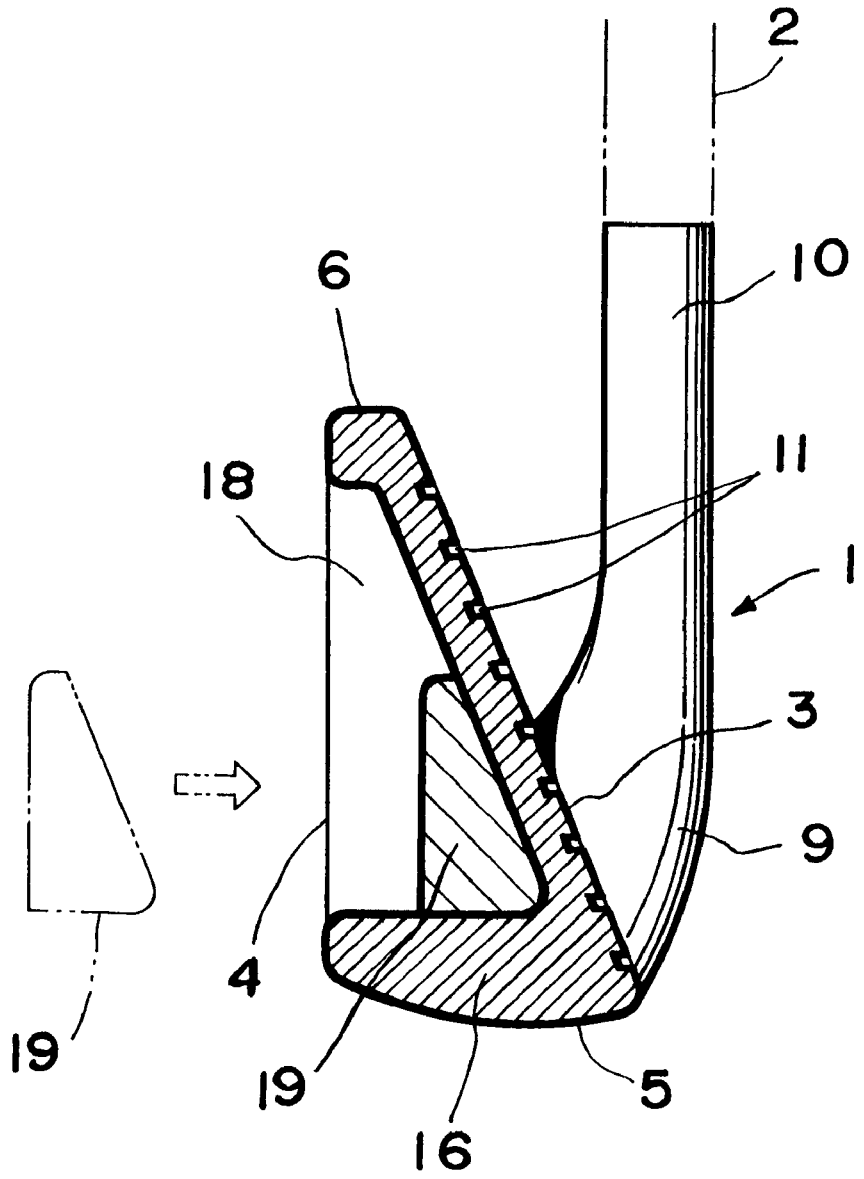
FIG. 5 is a section showing a head of a short iron of a second embodiment of the invention.
Figure 6:
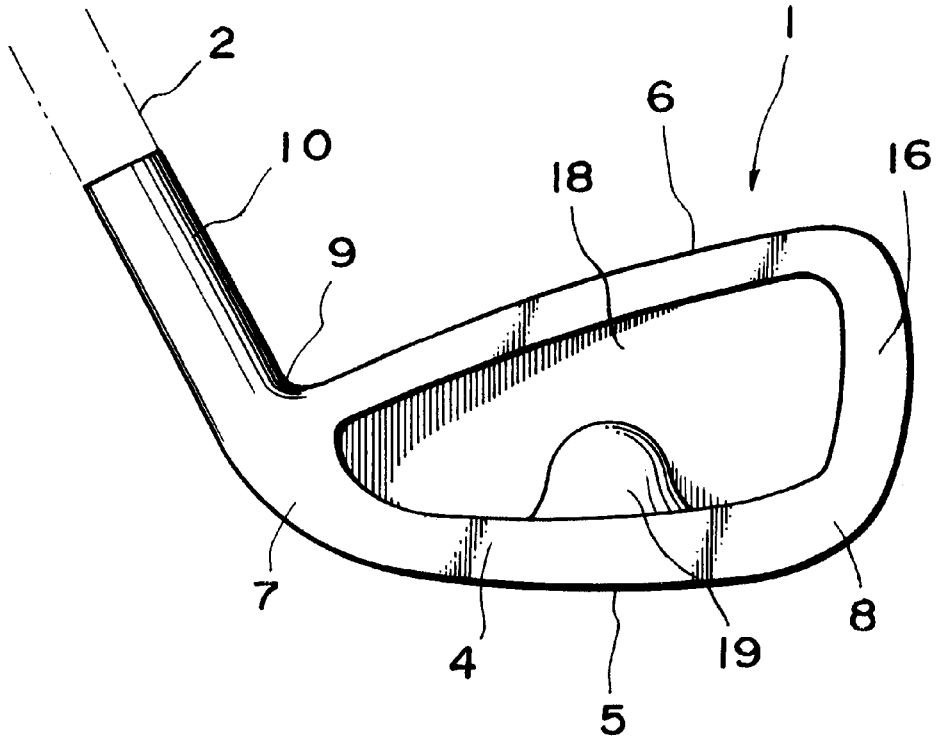
FIG. 6 is a rear view showing a head of a second embodiment of the invention.

Next, a second embodiment of the invention is explained with reference to FIG. 4 through FIG. 6. The same portions as those described in the first embodiment are designated as common reference numerals and their repeated detailed descriptions will be omitted.

In this second embodiment also, each of the heads 1 consists of a head body 16 making up the majority portion thereof, including the face 3, and a balance weight 19 which is block-shaped and fixed to the back 4 side of the head body 16. The balance weight 19 is joined into the cavity 18 formed at the back 4 side of the head body 16 in the same manner as the first embodiment, by means of suitable means such as mechanical fixing with welding or screws, or press-fitting with a press device. The balance weight 19 is located in a lower part of the center of the cavity 18 relative to the heel to toe direction, which is located in a lower portion relative to the whole head 1 also. The lower portion of the balance weight 19 is laterally widened relative to the upper portion thereof.

Unlike the foregoing first embodiment, the weight of the respective head bodies 16 according to the second embodiment becomes heavier as the club number increases. The materials for the head bodies 16 may be suitably chosen, which are desirably light and stiff ones such as titanium or titanium alloy.

The shape and size of the respective balance weights 19 do not depend on the club number, while the specific gravity of the material thereof differs per each club number. The specific gravity of the material of the respective balance weights 19 becomes smaller as the club number increases. As a result, the weight of the respective balance weights 19 becomes lighter as the club number increases. Incidentally, the decrease rate of the weight of the respective balance weights 19 associated with the increase of the club number, is smaller than the increase rate of the weight of the respective head bodies 16, so that the weight of the respective heads 1 increases as the club number increases.

To systematically change the specific gravity of the respective balance weights 19 per each club number, the alloy shown in the above-mentioned Table 1 may be used, for example. For example, the alloy of the above 1) may be used for the 1st and 2nd irons, the alloy of the above 2) for the 3rd and 4th irons, the alloy of the above 3) for the 5th and 6th irons, the alloy of the above 4) for the 7th and 8th irons, and the alloy of the above 5) for the 9th, pitching wedge and sandwedge.

In general, longer irons require longer travelling distances of balls than shorter irons. In other words, the smaller the club number of an iron club is, the longer travelling distance it requires. According to the second embodiment of the invention, the weight of the balance weights 19 provided at the lower portion of the heads 1 becomes lighter as the club number becomes larger, so that the centers of gravity of the respective whole heads 1 are lowered as the club number becomes smaller. With the lowered centers of gravity, struck balls become easy to be raised, so that the travelling distances thereof are elongated. Thus, there can be provided a set of iron golf clubs, realizing the respective proper travelling distances of balls, corresponding to each club number.

Specifically, by changing the specific gravity of the material for the respective balance weights 17 and 19 per each club number, as described in the first and second embodiments, the weight of the balance weights 17 and 19 can be changed per each club number, with the same shape and size thereof, so that a different characteristic of the respective clubs can be set per each club number. Further, since the shape and size of each of the balance weights 17 and 19 do not depend on the club number, the different balance weights 17 and 19 for different club numbers can be manufactured by forging or the like, using the same dies. It is even possible to use the same and single die for all the golf clubs. Accordingly, the manufacture of the balance weights 17 and 19 can be made easier, thus reducing their manufacturing costs. Additionally, as the appearances of the balance weights 17 and 19 can be made the same, irrespective of their club numbers, there can be provided a set of iron golf clubs whose design is well harmonized as a whole.

The present invention should not be limited to the foregoing embodiments but may be modified within a scope of the invention. For example, the materials of the balance weights are not limited to the copper tungsten alloy described in the foregoing embodiments. Further, the means for changing the specific gravity of the materials of the balance weights per each club number should not be limited to the aforesaid one in which the same type of certain alloys at varying compositional ratios are used. For example, different types of metal, such as the iron-based, the copper-based and/or the lead-based, may be used. It should be noted, however, that the use of the same type of metallic materials is advantageous in giving an uniformity in color or the like to a set of iron golf clubs. Moreover, the shapes, sizes and mounting positions of the balance weights should not be restricted to those illustrated in the foregoing embodiments. Although the specific gravity of the materials for the balance weights may vary from one club number to another, golf clubs may be divided into a few groups, such as a group of the 1st to 3rd irons, and another group of the 4th to 6th irons etc., so that a common balance weight may be used for each group. Alternatively, the shape and size of each balance weight may be changed per each club number, but golf clubs may be properly divided into groups so that balance weights in a common group may take the same shape and size. In that case as well, manufacturing productivity would be improved, as compared to the varying shapes and sizes per each club number.

What is claimed:

1. A set of iron golf clubs each of which comprising:

a head, having a head body with a face and a balance weight provided on a back side of the head body, a head body without the balance weight having substantially the same weight irrespective of a club number, the specific gravity of the material of each balance weight becoming larger as the club number increases, the dimension and configuration of each balance weight being the same irrespective of the club number; and a shaft connected to one side of said head, said shaft varying its length depending on a club number thereof.

2. A set of iron golf clubs according to claim 1, wherein the specific gravity of the material of each balance weight is larger than that of each head body.

3. A set of iron golf clubs according to claim 1, wherein the material of each head body is either titanium or titanium alloy.

4. A set of iron golf clubs according to claim 1, wherein the material of each balance weight is copper tungsten alloy.

5. A set of iron golf clubs according to claim 4, wherein the specific gravity of each balance weight is changed by changing the compositional ratio of copper to tungsten in said copper tungsten alloy.

6. A set of iron golf clubs each of which comprises:

a head, having a head body with a front side and a back side and a balance weight provided in the head body; and a shaft connected to one side of said head, said shaft varying its length depending on a club number thereof, wherein the specific gravity of a material of each balance weight is made larger as the club number becomes larger, and wherein each golf club further comprises a cavity formed at the back side of said head body, wherein each balance weight is fixed to the center of the cavity relative to a heel-to-toe direction, said balance weight being formed to narrow as it extends from a lower face towards an upper face inside the cavity.

* * * * *